US005622290A

United States Patent [19]

Pole

[11] Patent Number: 5,622,290

[45] Date of Patent: Apr. 22, 1997

[54] WATER-TIGHT FLOW CONTROLLER FOR A SHIP

[75] Inventor: Charles D. Pole, Goulais River, Canada

[73] Assignee: ULS Corporation, Toronto, Canada

[21] Appl. No.: 421,786

[22] Filed: Apr. 14, 1995

[30] Foreign Application Priority Data

Apr. 19, 1994 [GB] United Kingdom ..... 9407741

[51] Int. Cl.[6] ..... B65D 47/00

[52] U.S. Cl. ..... 222/502; 222/559; 222/504; 105/282.2

[58] Field of Search ..... 222/502, 503, 222/504, 559, 561; 414/328, 329, 519, 520; 105/280, 282.1, 282.2; 114/120; 298/27

[56] References Cited

U.S. PATENT DOCUMENTS

| | | | |
|---|---|---|---|
| 835,595 | 11/1906 | Bishop | 222/502 |
| 3,601,268 | 8/1971 | Bethge | 114/120 X |
| 4,004,700 | 1/1977 | Empey | 222/503 X |
| 4,278,190 | 7/1981 | Oory et al. | 222/561 |
| 4,338,058 | 7/1982 | Davenport | 222/503 X |
| 4,402,436 | 9/1983 | Hellgren | 222/559 X |
| 4,428,504 | 1/1984 | Bassett et al. | 222/559 X |
| 4,528,913 | 7/1985 | Randolph | 105/282.2 |
| 4,574,989 | 3/1986 | Pole | 222/502 X |
| 4,583,901 | 4/1986 | Tyrer | 222/502 X |
| 5,005,490 | 4/1991 | Overheidt | 105/282.2 |
| 5,360,295 | 11/1994 | Anderson | 105/282.2 X |

FOREIGN PATENT DOCUMENTS

| | | | |
|---|---|---|---|
| 587985 | 12/1959 | Canada | 105/282.2 |

*Primary Examiner*—Kevin P. Shaver
*Attorney, Agent, or Firm*—Daryl W. Schnurr

[57] ABSTRACT

A flow controller for the hopper of a self-unloading ship controls the flow of particulate material from the hopper. The controller is a throat having an opening and a movable gate to open and close the opening. The gate has a sloped central surface that blocks the opening. When the gate is open, particulate material in the hopper flows out of the hopper through the opening and onto the central surface. From the central surface the particulate materials flow onto the conveyor system of the self-unloading ship. The throat has a seal surrounding the opening with a corresponding bead surrounding the central surface on the gate. When the gate and throat are in a closed position, the gate is water-tight. When the gate is open, the seal is located away from the flow of material.

15 Claims, 6 Drawing Sheets

WATER-TIGHT FLOW CONTROLLER FOR A SHIP

BACKGROUND OF THE INVENTION

1. Field of the Invention

This invention relates to a flow controller located at the base of a hopper in a hold of a self-unloading ship and in particular, to a flow controller that controls the flow of particulate material from said hopper and can be made water-tight when in a closed position.

2. Description of the Prior Art

Hydraulically-operated hopper gates for self-unloading ships are known. U.S. Pat. No. 4,004,700 naming Empey as inventor describes a gate that is divided into two horizontal segments that are mounted on tracks and hydraulically controlled to move horizontally along the tracks between a closed and open position.

U.S. Pat. No. 3,601,268 naming Bethge, et al. as inventors describes what purports to be a water-tight gate for use in the hold of a ship having a continuous conveyor belt. In a closed position, a lower gate section and an upper gate section come together with the conveyor belt in between. In U.S. Pat. No. 4,428,504 naming Bassett, et al. as inventors, a gate assembly has inflatable seals to prevent the escape of lumped material from the hopper as well as effectively preventing water or other fluids from being introduced into the hopper. Previous gates are not water-tight or use inflatable seals that tend to leak or deflate with time, or require a constant supply of pneumatic pressure, or require the use of plugs in addition to the gate, or are not water-tight, or do not permit the conveyor to be used unless all of the gates have been opened, or they are expensive, or complex, or they leak as the gate wears, or as the seals become worn by particulate material being discharged from the gate. See also U.S. Pat. No. 4,574,989 naming Charles D. Pole as inventor.

SUMMARY OF THE INVENTION

A flow controller located at a base of a hopper in a hold of a self-unloading ship to control the flow of particulate material from said hopper has a throat located in said base and a gate corresponding to said throat, said throat having an opening therein. The gate is sized and shaped to removably block said opening, said gate being movable relative to said throat between a closed position and an open position. A seal surrounds said opening and is located between said throat and said gate to seal said opening when said gate is in a closed position. The gate has a central surface to receive particulate material flowing from said throat when said gate is in an open position and to block said opening when said gate is in a closed position. The central surface is sloped to be self-cleaning when said gate is in an open position. The central surface provides a slope to said gate, said throat having a slope to correspond and mesh with said gate, said gate being in a closed position when said gate contacts said throat with said seal therebetween so that said opening is water-tight. The gate is in an open position when said gate moves from said closed position so that said opening is at least partially open.

Preferably, the throat and gate are shaped relative to one another so that the seal is located out of a flow path of particulate material when the gate is in an open position. More preferably, the angle of the central surface to the horizontal is in a range of 10° to 80° and still more preferably said angle is approximately 35°.

DESCRIPTION OF A PREFERRED EMBODIMENT

Figure 1:
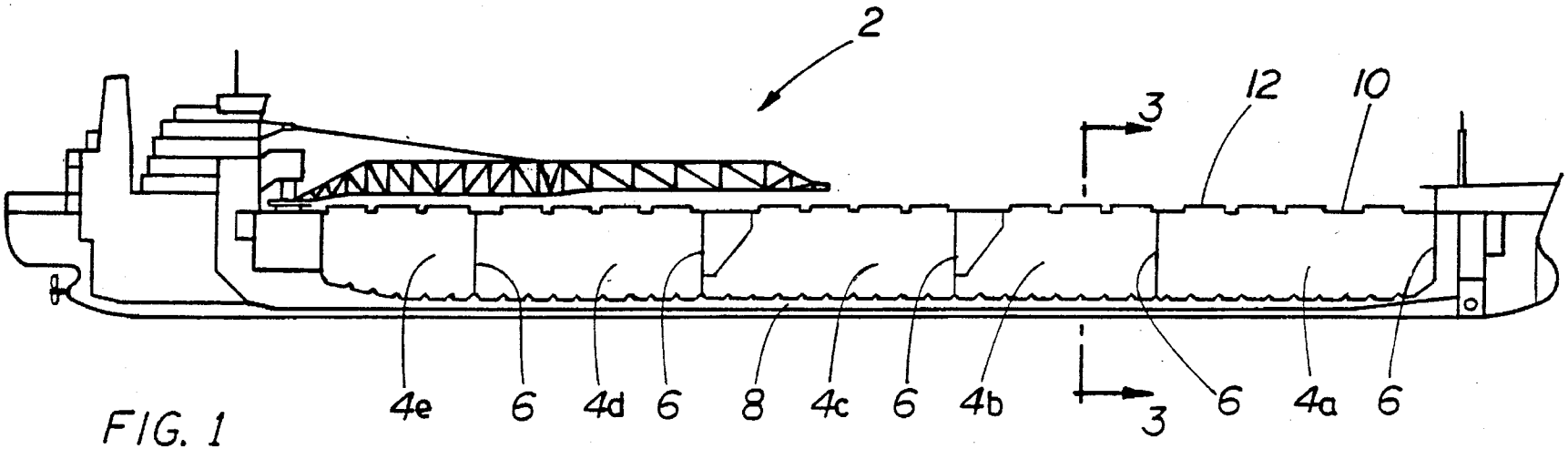
FIG. 1 is a schematic side view of a ship.

In FIG. 1, there is shown a schematic side view of a typical self-unloading ship 2 having five cargo holds **4*a*, 4*b*, 4*c*, 4*d*, 4*e*, each cargo hold being separated from the adjacent hold by a bulkhead 6. If the ship 2 contained gates that were not water-tight, it can be seen that flooding of one of the cargo holds, for example 4*b*, would flood the remaining cargo holds as well as a tunnel 8 beneath the holds 4*a*, 4*b*, 4*c*, 4*d*, 4*e*. Each hold is made up of several compartments (that are not separated from one another) and are made accessible from a deck 10 through hatches 12**.

Figure 2:
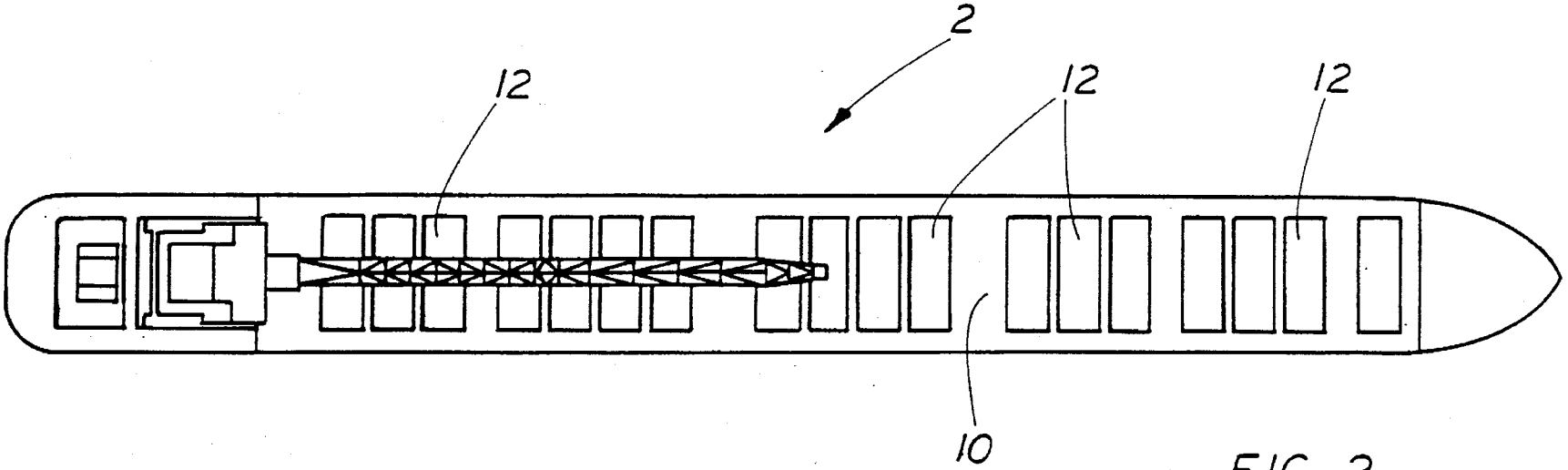
FIG. 2 is a schematic top view of the ship of FIG. 1.

In FIG. 2, there is shown a schematic top view of the ship 2 of FIG. 1. It can be seen that the deck 10 has various hatches 12 which allow for access to each of the holds **4*a*, 4*b*, 4*c*, 4*d*, 4*e***.

Figure 3:
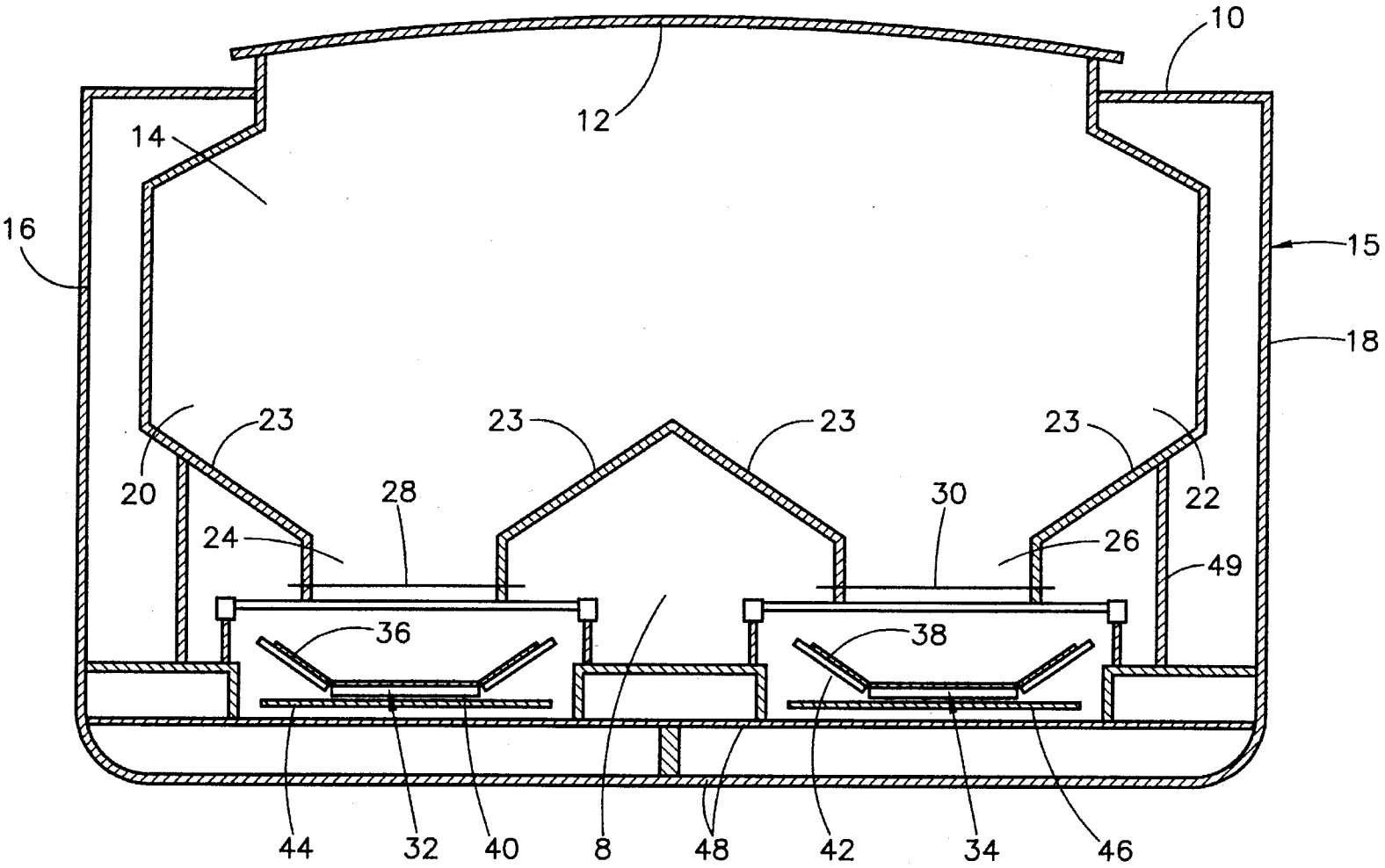
FIG. 3 is a sectional view of the ship through the lines 3—3 of FIG. 1.

FIG. 3 is a sectional view through the lines 3—3 of FIG. 1. It can be seen that compartment 14 of the hold **4*b* is located within a shell 15 of the ship 2 and extends between the sides 16, 18 of the ship 2. The compartment 14 is divided into two lateral hoppers 20, 22, each hopper providing sloped surfaces 23 to direct particulate material (not shown) through throats 24, 26, gates 28, 30 (when the gates are open) and onto conveyors 32, 34 respectively for removal from the ship. The conveyors 32, 34 are continuous with the upper portion 36, 38 being supported by rollers 40, 42 that are arranged in a U-shape and the lower portion 44, 46 respectively being the return portion. The ship 2 has a double-walled bottom 48. With the hoppers 20, 22 and water-tight fore-and-aft bulkheads 49, the side walls are also double-walled. Water entering one of the side walls 16, 18 is prevented from entering the tunnel 8**.

Figure 4:
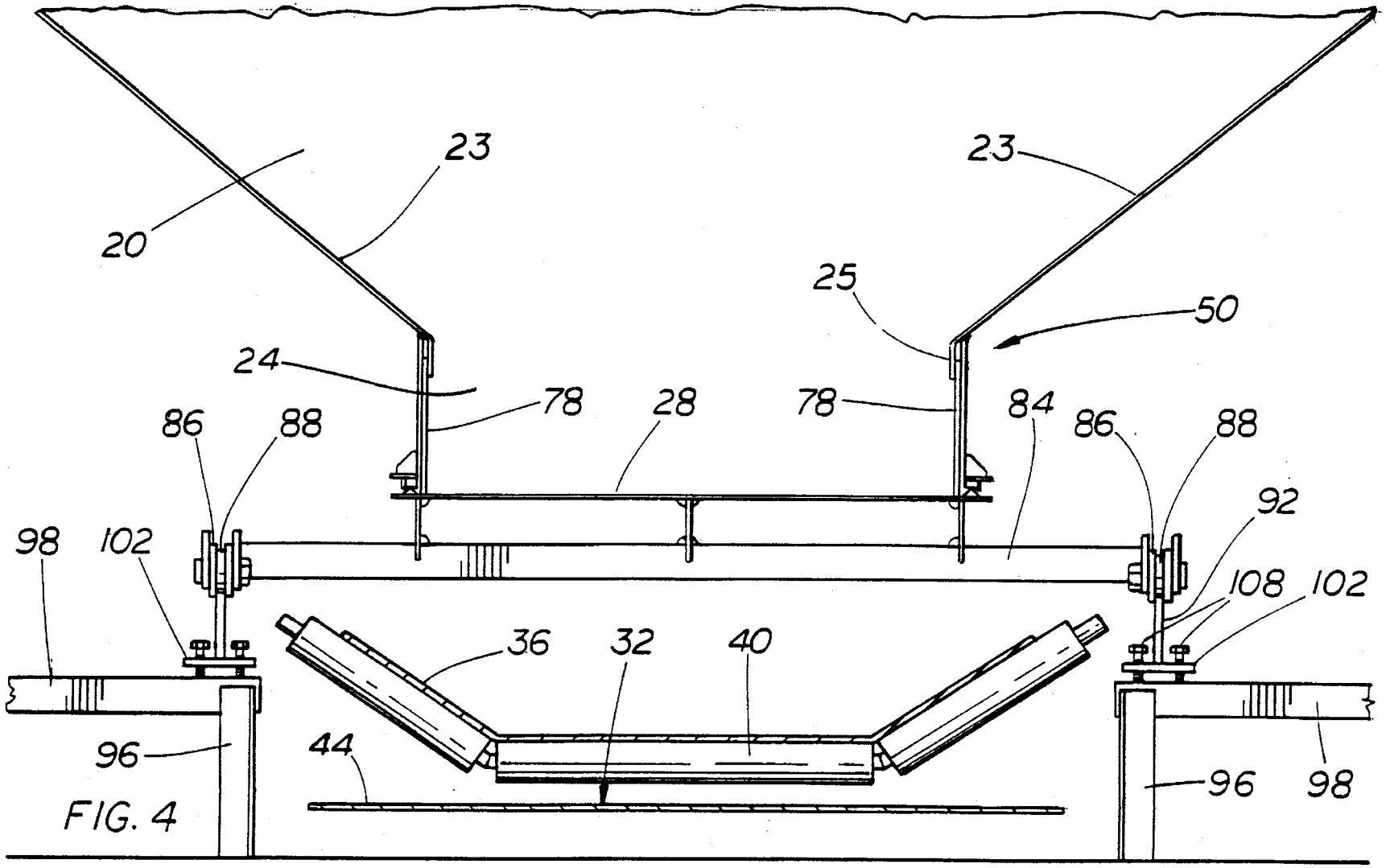
FIG. 4 is a front view, partially in section, of a flow controller extending laterally above a conveyor.
Figure 5:
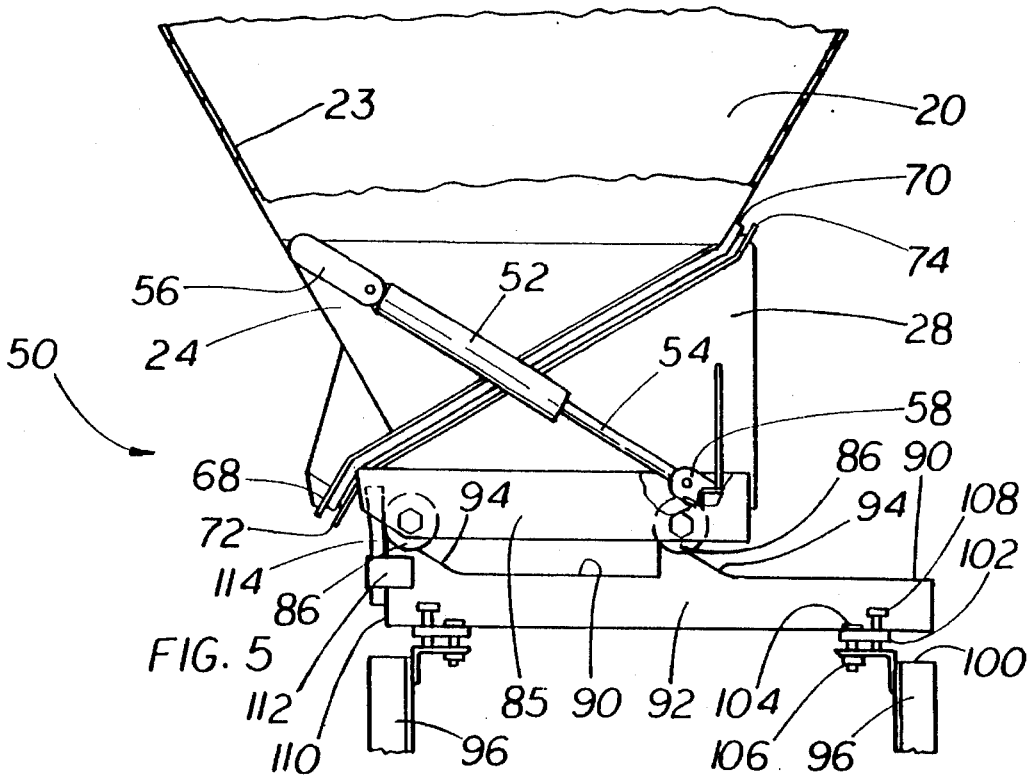
FIG. 5 is a side view, partially in section, of a flow controller in a closed position.
Figure 6:
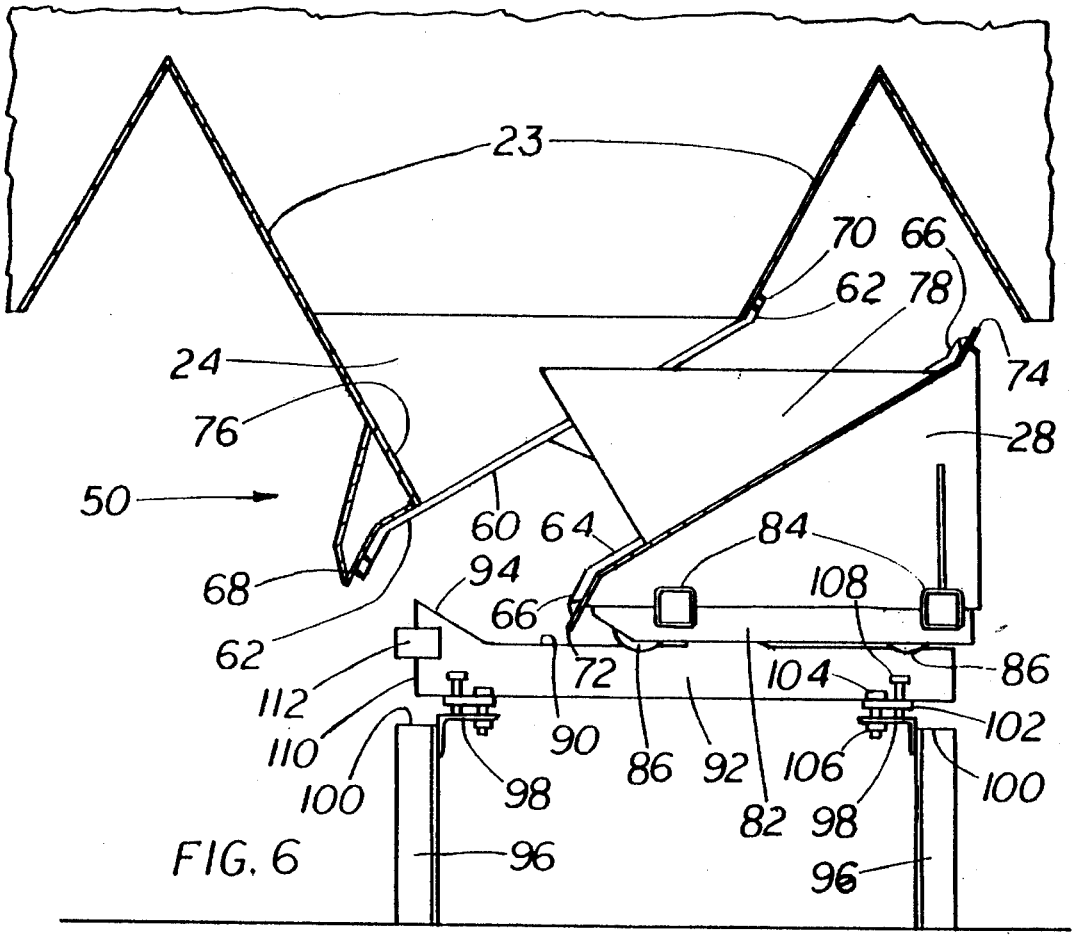
FIG. 6 is a side view, partially in section, of a flow controller in an open position.

In FIG. 4, there is shown a partial cross-sectional end view of a flow controller 50. In FIGS. 5 and 6, there is shown a partial cross-sectional side view of a flow controller 50 in a closed position and an open position respectively. There are several flow controllers 50 located in each of the holds **4*a* to 4*e* of the ship 2. For example, the hold 4*b*, through which the section 3—3 has been taken in FIG. 1, would have eight flow controllers 50 along each side 16, 18 of the ship 2 for a total of sixteen flow controllers between the bulkheads 6 of that particular hold 4***b*. The remaining holds 4*a*, 4*c*, 4*d*, 4*e* have a series of hoppers and flow controllers as well. In FIGS. 4, 5 and 6, the hopper is designated as hopper 20, having throat 24 and gate 28. The flow controllers 50 throughout the ship are preferably all identical to one another. For example, the throat 26 and the gate 30 of FIG. 3 are identical to the throat 24 and gate 28.

In FIG. 5, a hydraulic cylinder 52 has a rod 54. The cylinder 52 is affixed to the throat 24 by a bracket 56 and the rod 54 is affixed to the gate 28 by a bracket 58. The brackets 56, 58 are pivotally mounted so that the cylinder 52 and rod 54 can pivot slightly as the gate moves between a closed position shown in FIG. 5 and an open position shown in FIG. 6. There are two cylinders 52 (only one of which is shown) on each side of the flow controller 50. The cylinder 52 has been omitted from FIGS. 4 and 6.

The throat has an opening 60 (best seen in FIG. 10) therein and a seal 62 surrounding said opening. The seal 62 is located between said gate and said throat to seal the opening 60 when the gate is in the closed position shown in FIG. 5. The gate has a central surface 64 (best seen in FIG. 10) with a bead 66 surrounding said central surface. The central surface is sloped at a sufficient angle to the horizontal to be self-cleaning when the gate is in an open position. In other words, when particulate materials exit through the opening 60 of the throat 24, the materials strike the central surface 64 and, by gravity, the materials flow from the central surface 64 to the conveyor 32 (not shown in FIGS. 5 and 6) located beneath the gate 28. The bead 66 forms a water-tight line of contact with the seal 62 when the gate is in a closed position. The angle of the central surface 64 to the horizontal is preferably in a range of 10° to 80° and, still more preferably, is approximately 35°. It can be seen that the throat 24 is angled downward at a lower end 68 and is angled upward at an upper end 70. The shape of the central surface 64 of the gate 28 corresponds to the shape of the throat 24 and is angled downward at a lower end 72 and upward at an upper end 74. A baffle 76 extends downward from the sloped surface 23 of the hopper 20 to keep particulate material flowing through the opening 60 away from the seal 62.

The gate 28 has two vertical side plates 78 (only one of which is shown) to prevent the particulate material from flowing off sides of the central surface 64. The vertical side plates 78 are located inside of the bead 66 and keep the material away from the bead 66. Further, at the lower end 72, the bead 66 is angled downward so that the particulate material flows over top of the bead and therefore does not cause the bead to wear significantly. The gate 28 has a support frame 82 with cross-supports 84. Mounted within the frame 82 are four wheels 86 (only two of which are shown). The wheels 86 have a groove 88 which is sized and shaped to receive the tracks 90. Only two of the tracks 90 are shown in the drawings. There is one track for each of the four wheels. Two tracks 90 are located in a metal plate 92 on each side of the gate 28. Each of the tracks have a sloped end section 94 near the throat 24 that curves sharply upward towards said throat. The sloped section 94 is substantially normal to the downward extending end 68 of the throat 24 and ensures rapid and effective closing and opening of the gate.

As can be seen from FIGS. 5 and 6, when the gate is closed, the wheels 86 are on an uppermost end of the sloped section 94 and when the gate is fully opened, the wheels 86 are located on a main flat section of the tracks 90 further away from the throat 24. The plate 92 of the tracks 90 is adjustably mounted on vertical support members 96. The members 96 are angle irons and support horizontal angle irons 98 at a top 100 thereof. The plates 92 are welded to an elongated plate 102. The plates 102 are bolted to the horizontal angle irons 98 by bolts 104 and nuts 106. Bolts 108 extend through the elongated plate 102 and abut the angle irons 98 so that the tracks 90 can be adjusted vertically to ensure that the gate 28 can be held in a water-tight position against the throat 24 when the gate is in the closed position.

The hydraulic cylinders 52 on each side of the flow controller 50 are connected into a hydraulic flow circuit in a conventional manner. Hydraulic circuits are well known and common on self-unloading ships to open and close conventional gates and the details of the circuit are therefore not described. Similarly, the conveyor belt 32 and rollers 40 are conventional on self-unloading ships and the details of operation of the conveyor are not further described.

Mounted to an end 110 of the plate 92 is a U-shaped bracket 112. The bracket 112 is shaped to receive a locking pin 114 to lock the gate and throat in the closed position shown in FIG. 5. When the flow controller is closed hydraulically, the gate can be locked in position by inserting two locking pins (only one of which is shown), one on each side of the gate 28. The locking pins 114 have an upper portion that is tapered outward to ensure that the pins fits tightly between the frame 82 of the gate and the bracket 112 of the plate 92. The locking pins 114 are manually inserted and removed. When the locking pins are suitably inserted, the hydraulic system can be shut down and the gate will remain in the locked position. The hydraulic system can then be activated before the locking pins are removed. After the locking pins have been removed, the gate can be opened hydraulically. After the cargo is unloaded, the gates can be closed hydraulically and the locking pins can again be inserted to repeat the cycle.

Figure 7:
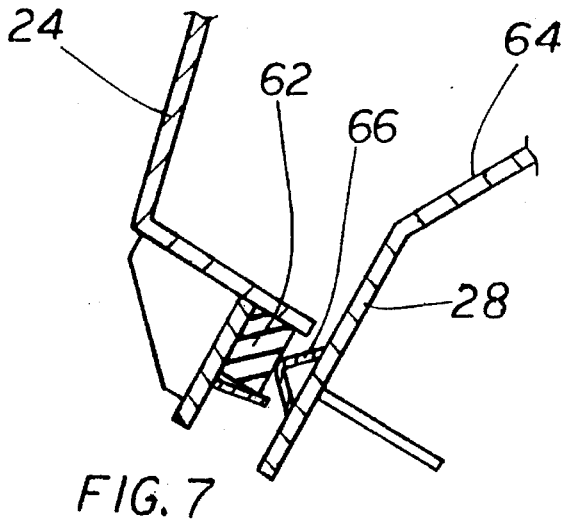
FIG. 7 is a sectional view of a bead and seal at a lower end of the flow controller when the flow controller is in a closed position.
Figure 8:
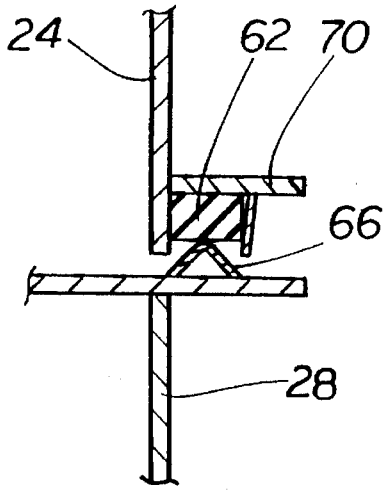
FIG. 8 is a sectional view of a seal and bead at an upper end of the flow controller when the flow controller is in a closed position.

In FIG. 7, there is shown a sectional view of the seal 62 and the bead 66 at the lower end 68 of the throat 24. It can be seen that the bead 66 has a triangular shape with an apex of the triangle pressed into the seal 62 when the gate and throat are in a closed position. It can also be seen that the seal 62 is recessed so that it is kept away from the flow of particulate material. Similarly, in FIG. 8, the seal 62 is shown at the upper end 70 with the bead 66 in a closed position.

Figure 9:
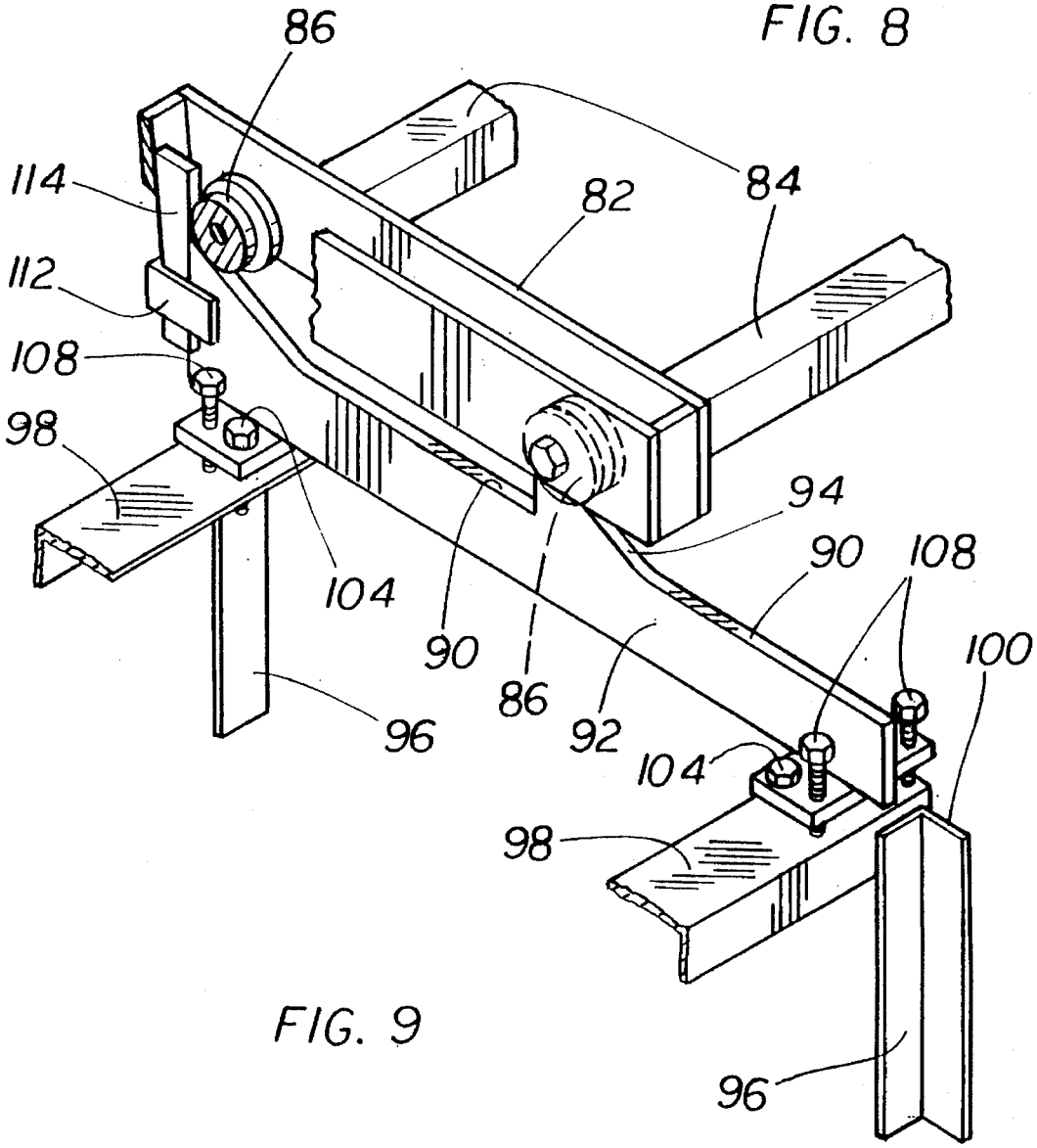
FIG. 9 is a partial perspective view of a frame of the gate on tracks in a locked position.

In FIG. 9, there is shown a partial perspective partially cut-away view of the plate 92 of the tracks 90 and the support frame 82 and cross-supports 84 of the gate 28. An outer portion of one of the wheels 86 has been cut-away to better expose the groove 88. The locking pin 114 has been inserted into the bracket 112 to lock the gate in position on the tracks 90.

Figure 10:
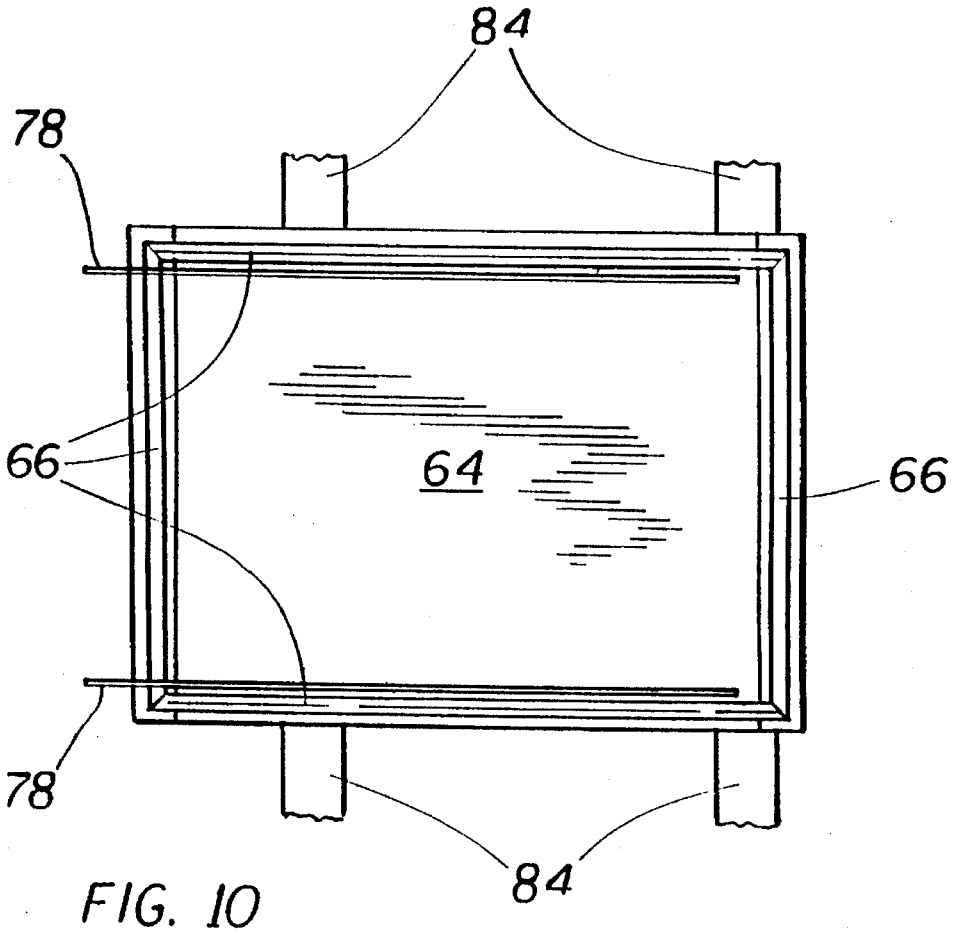
FIG. 10 is a top view of a gate.

In FIG. 10, there is shown a top view of the throat 24 and the gate 28. It can be seen that the bead 66 has a generally rectangular shape and surrounds the central surface 64. The opening 60 and seal 62 have a corresponding shape to the bead 66 and central surface 64 respectively but are not shown in FIG. 10. The opening 60 must be large enough to receive the vertical plates 78.

Figure 11:
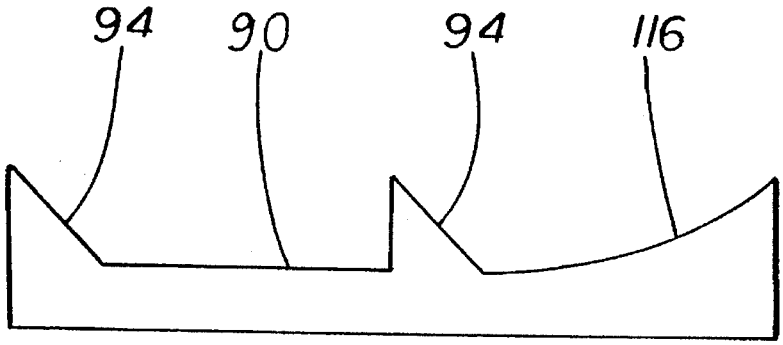
FIG. 11 is a schematic view of a further embodiment of tracks having a curved portion.

In FIG. 11, there is a shown a schematic view of a further embodiment of the tracks. Two tracks 116 (only one of which is shown) for the two wheels that are located further away from the throat are curved at an end away from the throat so that, as the gate opens, the wheels 86 travel down the sloped section 94. From that point on, the two wheels located further from the throat travel on the two tracks 116 which curve upward to increase the angle of the central surface 64 as the gate opens further.

While hydraulic cylinders, one on each side of the flow controller are preferred, the flow controller can be opened and closed by other mechanical means. It is important that the seal surrounding the opening of the throat and the bead surrounding the central surface of the gate are located outside of the flow of material from the throat. Since the seal is made of flexible and resilient material, it will wear much more quickly than the bead, which can be made of a rigid metal material. Since the seal is on the throat and is protected by flanges, it is located well away from the flow of particulate material. The lower end of the central surface of the gate is oriented downward from the rest of the central surface to move the bead at the lower end of the gate further away from the flow of particulate material. The particulate material flows overtop of the bead. With time, there will be some wear on the bead as some of the particulate material will contact the bead. However, as the contact is minimal, the wear will also be minimal. If the gate does wear, the tracks can be adjusted to compensate for the wear.

While there are two tracks located on each plate 92, each track could be located on a separate plate to provide even greater flexibility in the adjustment of the tracks. The sloped section 94 on each of the tracks allows the bead of the gate to meet the seal of the throat at substantially a 90° angle. The vertical side plates 78 prevent particulate material from exiting at the side of the gate. This keeps the bead at the side of the gate free of stray material, which would interfere with the sealing surfaces. The locking pin 114 allows the gate to be locked in a water-tight closed position during the voyage of the ship when the hydraulic system is not operating. The purpose of the water-tight gates is to prevent the flooding in one hold to flow out of the gates in that hold through the tunnel and into another hold, thereby ultimately placing the entire ship in jeopardy as all of the holds are interconnected via the tunnel.

The flow controller of the present invention not only provides a water-tight seal, it also allows the flow of particulate material from the hopper to the conveyor belt to be controlled. The gate is self-cleaning so that very little residual material, if any, remains on the gate after the hopper is empty.

While the gate described in the drawings is mounted in a fore-and-aft direction and that is the preferable mounting direction, the gate could be designed to be mounted athwartships. The size of the gate can vary depending on the size of the conveyor belt and also on the type of cargo to be discharged. The fore-and-aft dimension of the gate could vary between one foot and nine feet with about four feet being preferable. The athwartship dimension (when the gate is mounted in a fore-and-aft direction) could vary between one foot and seven feet with about five feet being preferable. The seal can be formed with rubber or any suitable packing material and the bead can be formed of a metal, for example, steel or other suitably rigid material.

It is preferable to have the central surface 64 slope down towards the direction of travel of the conveyor belt to attain a smoother transition of material between the gate and the belt. The angle of the sloped surface 64 can vary by adjusting the height and profile of the end of the tracks away from the gate.

It is an advantage of the flow controller of the present invention that the gate and throat move away from one another substantially at right angles.

The angle of the central surface to the horizontal can vary but is preferably in the range from 10° to 80°. A 35° angle is preferable. A 30° angle will work very well for most materials as it will be self-cleaning. As the angle increases, the gate and the throat will have a greater vertical length and this will limit the volume available for the hopper. In other words, the cargo size will be reduced. If the angle is too small, the gate will no longer be self-cleaning. The self-cleaning feature may become unimportant for certain types of cargo or if the ship is being used for one type of cargo only. When the angle of the central surface to the horizontal is small, the vertical height of the gate and the throat can also be small and this allows the hopper or hold to be of greater volume.

What I claim as my invention is:

1. A flow controller located at the base of a hopper in a hold of a self-unloading ship to control the flow of particulate material from said hopper, said controller comprising a throat located in said base and a gate corresponding to said throat, said throat having an opening therein, said gate being sized and shaped to removably block said opening, said gate being movable relative to said throat between a closed position and an open position, a seal surrounding said opening and being located between said throat and said gate to seal said opening when said gate is in a closed position, said gate having a central surface to receive particulate material flowing from said throat when said gate is in an open position and to block said opening when said gate is in a closed position, said central surface being sloped to be self-cleaning when said gate is in an open position, said central surface providing a slope to said gate, said throat having a slope to correspond and mesh with said gate, said gate being in a closed position when said gate contacts said throat with said seal therebetween so that said opening is water-tight, said gate being in an open position when said gate moves from said closed position so that said opening is at least partially open.

2. A flow controller as claimed in claim 1 wherein the throat and gate are shaped relative to one another so that the seal is located out of a flow path of particulate material when the gate is in an open position.

3. A flow controller as claimed in claim 2 wherein an angle of the central surface to the horizontal is in a range of 10° to 80°.

4. A flow controller as claimed in claim 3 wherein said angle is approximately 35°.

5. A flow controller as claimed in claim 2 wherein the gate has wheels that are mounted on tracks, said gate moving along said tracks when said gate moves between an open and closed position, said tracks each having two sections, a main section further from said throat and a sloped section nearer to said throat, said sloped section being angled upward towards said throat to allow the gate to rapidly close or open.

6. A flow controller as claimed in claim 5 wherein the gate has four wheels and there are four tracks, each track having an end that is near to the throat where the track curves sharply upward towards said throat.

7. A flow controller as claimed in claim 6 wherein there are means to adjust the height of the tracks.

8. A flow controller as claimed in claim 6 wherein the tracks curve upward at an end opposite to said throat so that the angle of the central surface to the horizontal increases as the gate is opened to a greater extent.

9. A flow controller as claimed in claim 2 wherein the seal surrounds the opening of the throat and a corresponding bead surrounds the central surface, the seal and bead being located out of a flow path of particulate material when the gate is in an open position, said seal being made out of flexible and resilient material, said bead being rigid.

10. A flow controller as claimed in claim 6 wherein there are hydraulic cylinders extending between said throat and said gate to operate the gate between an open position and a water-tight closed position.

11. A flow controller as claimed in claim 6 wherein there is a locking pin for the gate to lock said gate in a closed position.

12. A flow controller as claimed in claim 11 wherein there are two locking pins, one on each side of said gate extending between a frame of said gate and a bracket on said tracks.

13. A flow controller as claimed in claim 2 wherein there are locking means to lock the gate and throat in a closed position.

14. A flow controller as claimed in claim 10 wherein the lock is a tapered pin that can be inserted within two corresponding openings, one on said gate and one on said tracks when said gate and throat are in a closed position.

15. A flow controller as claimed in claim 2 wherein the gate has a wedge shape.

* * * * *